US008404956B2

(12) United States Patent
Ragas et al.

(10) Patent No.: US 8,404,956 B2
(45) Date of Patent: Mar. 26, 2013

(54) FINGERBOARD FOR STRINGED MUSICAL INSTRUMENT

(75) Inventors: Ryan Ragas, Youngsville, LA (US); Paul August Ragas, New Orleans, LA (US)

(73) Assignees: Ryan Ragas, Spring, TX (US); Paul August Ragas, New Orleans, LA (US)

( * ) Notice: Subject to any disclaimer, the term of this patent is extended or adjusted under 35 U.S.C. 154(b) by 22 days.

(21) Appl. No.: 13/274,337

(22) Filed: Oct. 16, 2011

(65) Prior Publication Data

US 2012/0090444 A1 Apr. 19, 2012

Related U.S. Application Data

(60) Provisional application No. 61/394,266, filed on Oct. 18, 2010.

(51) Int. Cl.
*G10D 3/00* (2006.01)

(52) U.S. Cl. ..... 84/293; 84/314 R

(58) Field of Classification Search ..... 84/314 R, 84/293

See application file for complete search history.

(56) References Cited

U.S. PATENT DOCUMENTS

| | | | | | |
|---|---|---|---|---|---|
| 3,481,238 | A * | 12/1969 | Veres | 84/267 |
| 4,200,023 | A * | 4/1980 | Kaman | 84/293 |
| 4,359,924 | A * | 11/1982 | Brunet | 84/293 |
| 4,508,003 | A * | 4/1985 | Smakula | 84/293 |
| 4,846,038 | A * | 7/1989 | Turner | 84/293 |
| 5,018,423 | A * | 5/1991 | Bunker et al. | 84/293 |
| 5,753,837 | A * | 5/1998 | Petillo et al. | 84/293 |
| 5,990,396 | A * | 11/1999 | Lasner | 84/293 |
| 6,051,765 | A * | 4/2000 | Regenberg et al. | 84/293 |
| 6,100,458 | A * | 8/2000 | Carrington et al. | 84/293 |
| 6,259,008 | B1 * | 7/2001 | Eddinger et al. | 84/293 |
| 7,326,838 | B1 * | 2/2008 | Bunker | 84/293 |
| 7,385,125 | B2 * | 6/2008 | Motsenbocker | 84/292 |
| 7,507,887 | B1 * | 3/2009 | Blanchard | 84/293 |
| 7,659,464 | B1 * | 2/2010 | Kokodis | 84/293 |
| 7,763,786 | B2 * | 7/2010 | Jones et al. | 84/314 R |
| 8,324,489 | B1 * | 12/2012 | Chapman | 84/314 R |
| 2012/0090444 | A1 * | 4/2012 | Ragas et al. | 84/314 R |
| 2012/0266734 | A1 * | 10/2012 | Kunstadt | 84/293 |

* cited by examiner

*Primary Examiner* — David Warren
*Assistant Examiner* — Robert W Horn

(57) ABSTRACT

This design is a fingerboard with an integrated neck adjustment mechanism to correct both up bow and back bow of a stringed instrument neck with the added ability to eliminate additional bulk associated with conventional guitar neck construction. It includes a metal plate as the fingerboard. Attached to the underside of the plate is a neck adjustment mechanism. By integrating the neck adjustment mechanism with the fingerboard a shallower depth for a routed truss rod channel is achieved. The metal plate reduces fingerboard bulk yet provides the stability needed to resist the string tension. This design also provides the ability of three characteristics to be used in one instrument that current designs and construction methods cannot achieve: thin necks, full scalloped fret boards and dual action truss rod functionality.

5 Claims, 4 Drawing Sheets

FINGERBOARD FOR STRINGED MUSICAL INSTRUMENT

CROSS-REFERENCE TO RELATED APPLICATION

This application is a non-provisional application of provisional application No. 61/394,266 filed on Oct. 18, 2010.

FIELD OF THE INVENTION

The subject invention relates generally to stringed musical instruments.

BACKGROUND OF THE INVENTION

Stringed musical instruments may be constructed in many ways yet typically are constructed with the same materials and components. The main components of a stringed instrument are the neck, body and headstock and they are all typically made of wood.

The headstock typically holds the tuning keys which are used to bring each string into proper pitch. Between the headstock and the neck is a component known as nut which serves two main purposes. It provides the proper spacing between each string and is the first point of contact which produces the first not of each open string. The term open string refers to an unfretted string. In some cases a zero fret is used in which it is the first note of each open string and a nut only provides the proper string spacing.

At the opposite end of the headstock is typically a body. The body serves many purposes and is also typically made of wood. Attached to the body at a specific location is a bridge. The bridge is the second point of contact which allows each string to vibrate and produce a note. The bridge can have individual saddles for each string or may be constructed of a single piece. Various materials can be used as the saddle material. The saddles provide the necessary string spacing at the bridge end and also have two adjustability features, string height or action, and intonation.

Between the headstock and the body is the neck. The neck is typically made of wood and is usually constructed with four main components: the main structural wood component, a fret board, frets and a truss rod. Fret boards, or fingerboards, may be constructed as fretless versions also, which do not include the fret component. The main structural element of the neck provides the majority of the stability necessary to compensate for the tension exhibited by the string tension and also provides a comfortable surface for the user's hands. The frets are spaced at specific distances from the nut and bridge and when each string is pressed against each fret a specific note is generated. The frets are typically made of metal and can be pressed, hammered, of slid into the slots that are cut into the fret board. The fret board is typically made of wood also. The truss rod provides additional stability and some provide adjustability of the neck flex. There are three types of truss rods: non-adjustable, one way, and two way or dual action. The non-adjustable model provides added stability. A one way truss rod can only control the neck flex in one direction and a two-way, or dual action, truss rod can adjust the neck bow in both directions, either up, or down, depending on the changes in string tension, humidity, temperature or any combination of the three.

The cross sectional shape of the neck is typically semicircular.

The truss rod is typically installed within the neck in a channel that is routed or cut along its longitudinal axis.

Other materials that have been used to construct stringed instruments and components of stringed instruments are carbon fiber, plastic and metal.

The three previously mentioned adjustability features play a very important role in adjusting a stringed instrument neck's playability. These adjustments are for neck bow, string height or action, and intonation. There are several factors that can create a need for variances in the neck bow from one player to the next. The gauge, or thickness of the strings, the tuning used, scale length, the force one uses to play, as well as personal preference are a few of the main variances. The combination of neck bow and action affect the intonation. Intonation is a compensation adjustment. Depending on the string height and neck bow, the amount of distance a string needs to travel to make contact with each fret can affect the desired pitch of each note. Intonation refers to the movement of the saddle towards the nut, to compensate for a lower than desired pitch or away from the nut to compensate for a higher than desired pitch, in reference to the scale length of the instrument. The scale length refers to the distance between the nut and the bridge and the fret spacing which is a result of the formula used to calculate fret placement. There is a delicate balance that exists between string height, neck bow, and intonation in order to achieve optimum playability.

Guitar necks also vary by individual preferences. They can be any combination of thick, thin, round, flat and many other preferences. Fret boards can also be made with a multitude of radii and some can even be fretless.

One feature of prior art necks which this invention attempts to overcome is the dimensional limitations on constructing neck with less bulk than with conventional methods and materials. Prior art necks which are considered the thinnest currently available lack the ability to provide dual action truss rod functionality due to the depth of the truss rod channel that is required to install prior art dual action truss rods. Another prior art neck feature is a full scalloped fret board. This means that a considerable amount of material between the frets is removed. The removal of the fret board material eliminates any friction that is caused by a user's fingers coming into contact with the fret board as a result of fretting each note. This feature is not achievable with any prior art thin neck as additional stability is compromised. On fretless versions, the fingerboard still has to be bulky to provide additional stability and be able to resist the forces exerted by prior art truss rod.

Prior art does not allow for thin necks with full scalloped fret boards or thin fretless fingerboards, and dual action truss rod functionality nor do they allow for stringed instrument necks to be constructed with less bulk than they are currently constructed.

There is a need that exists for stringed musical instruments with less bulky necks and fingerboards, dual action truss functionality and a full scalloped fret board feature all in the same instrument.

This invention successfully meets the aforementioned need by integrating a shallow neck adjustment mechanism with a new, thinner fingerboard design.

DRAWING EXPLANATIONS

Figure 1:
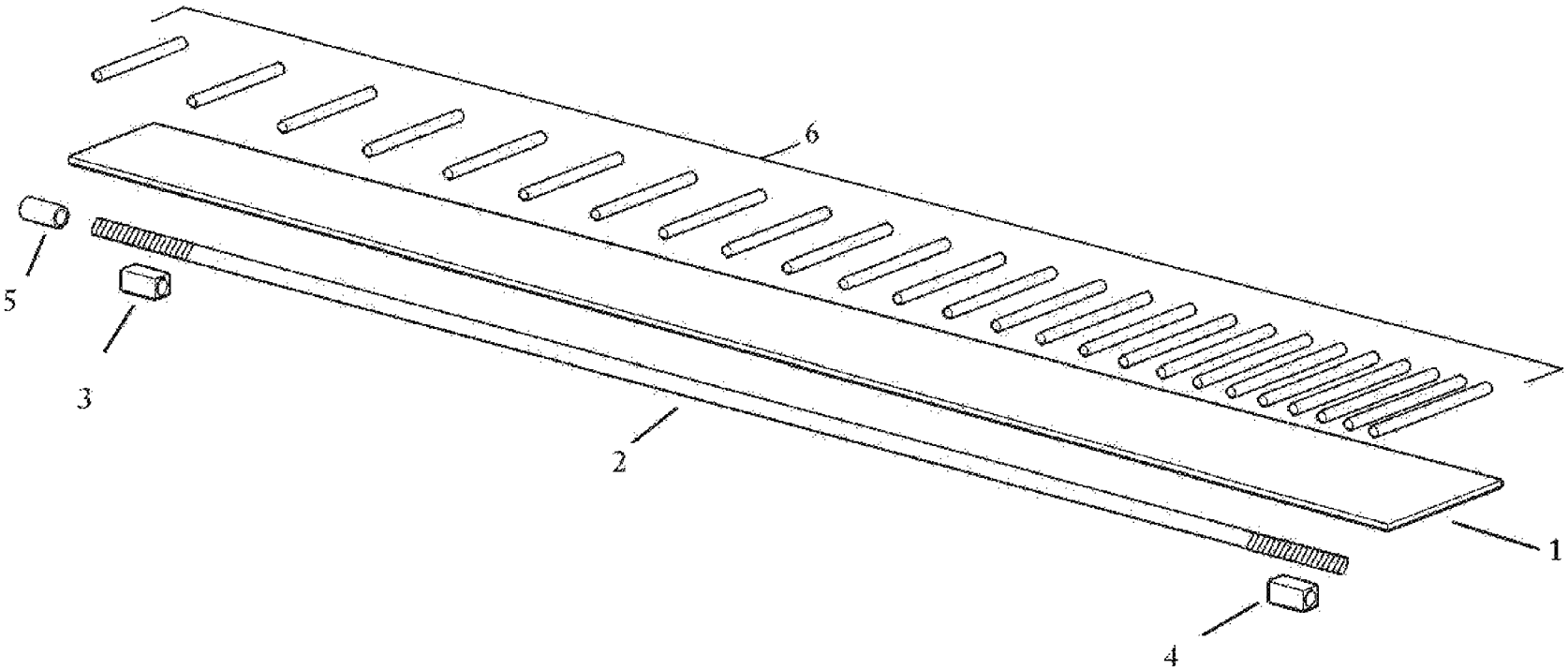
FIG. 1 is an exploded view of the integrated fingerboard and neck adjustment apparatus which includes a plurality of frets.

FIG. 1 is an exploded view of all components of the invention. A plate 1 has a first and second end and a top and bottom surface. A rod 2 has a first threaded end and second threaded end. Said threads can have a different pitch or different thread directions to provide adjustability. A first and second threaded block 3 and 4 respectively may also have differing thread directions or differing thread pitches. Adjustment nut 5 may be constructed in several ways as long as it provides the ability to rotate said rod 2 in both a clockwise and counter-clockwise direction. A plurality of frets 6 may also be present but are not necessary to provide adjustability.

Figure 2:
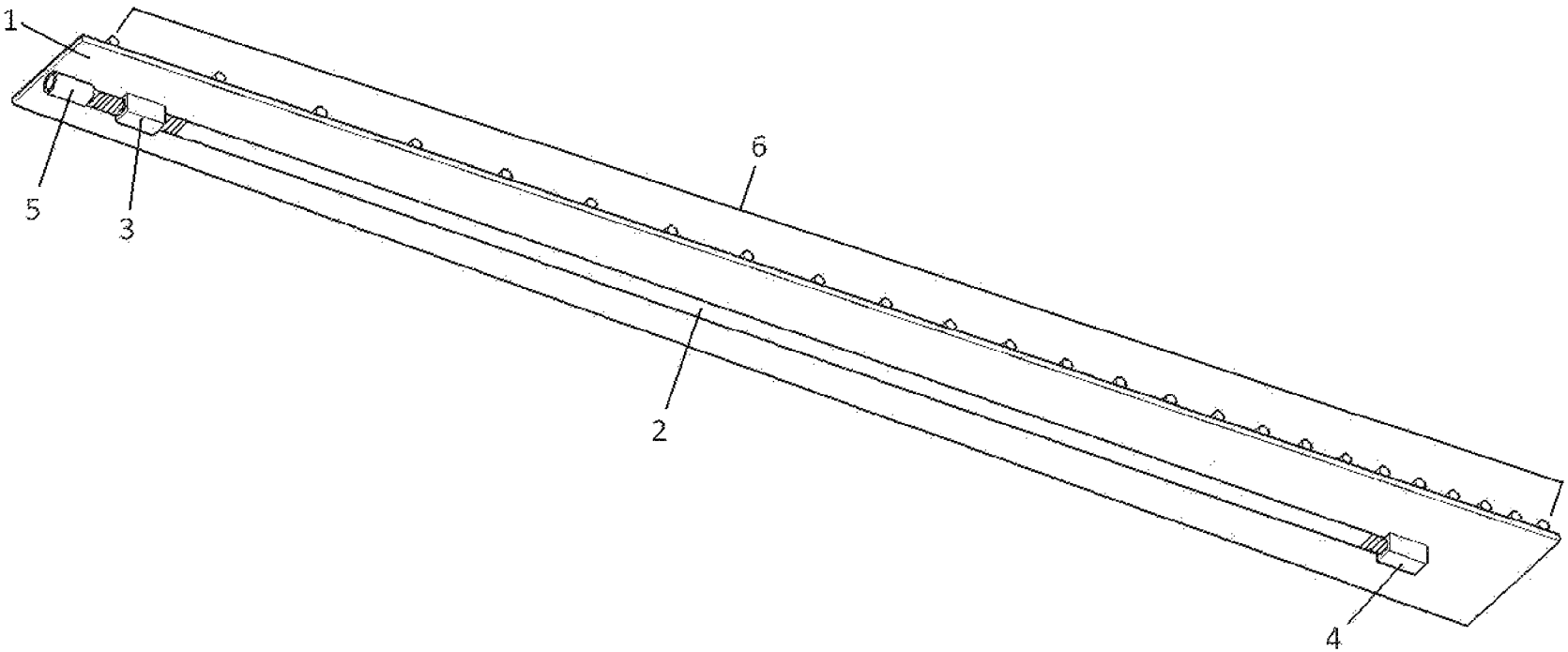
FIG. 2 is an underside perspective of the assembled fingerboard and truss rod apparatus.

FIG. 2 is an underside perspective of the assembled fingerboard and truss rod apparatus. First end of said rod 2 is threaded and second end of rod 2 is also threaded. First threaded end of said rod 2 is threaded through a first threaded block 3 and second threaded end of said rod 2 is threaded through a second threaded block 4. Said first threaded block 3 has similar threads to first threaded end of said rod 2 and said second threaded block 4 has similar threads to second threaded end of said rod 2. Permanently attached to said first threaded end of rod 2 is an adjustment nut 5. Said first threaded block 3 is permanently attached to the underside of first end of said plate 1 by means of a fusible metal alloy and said second threaded block 4 is permanently attached to the underside of said second end of plate 2 by means of a fusible metal alloy. Rotating the adjustment nut 5 in either direction mentioned will cause the fingerboard plate 2 to bow in either an upward or downward direction. A plurality of frets 6 may or may not be present. Said frets 6 are attached perpendicular to the longitudinal axis to the top surface of said plate 2.

Figure 3:
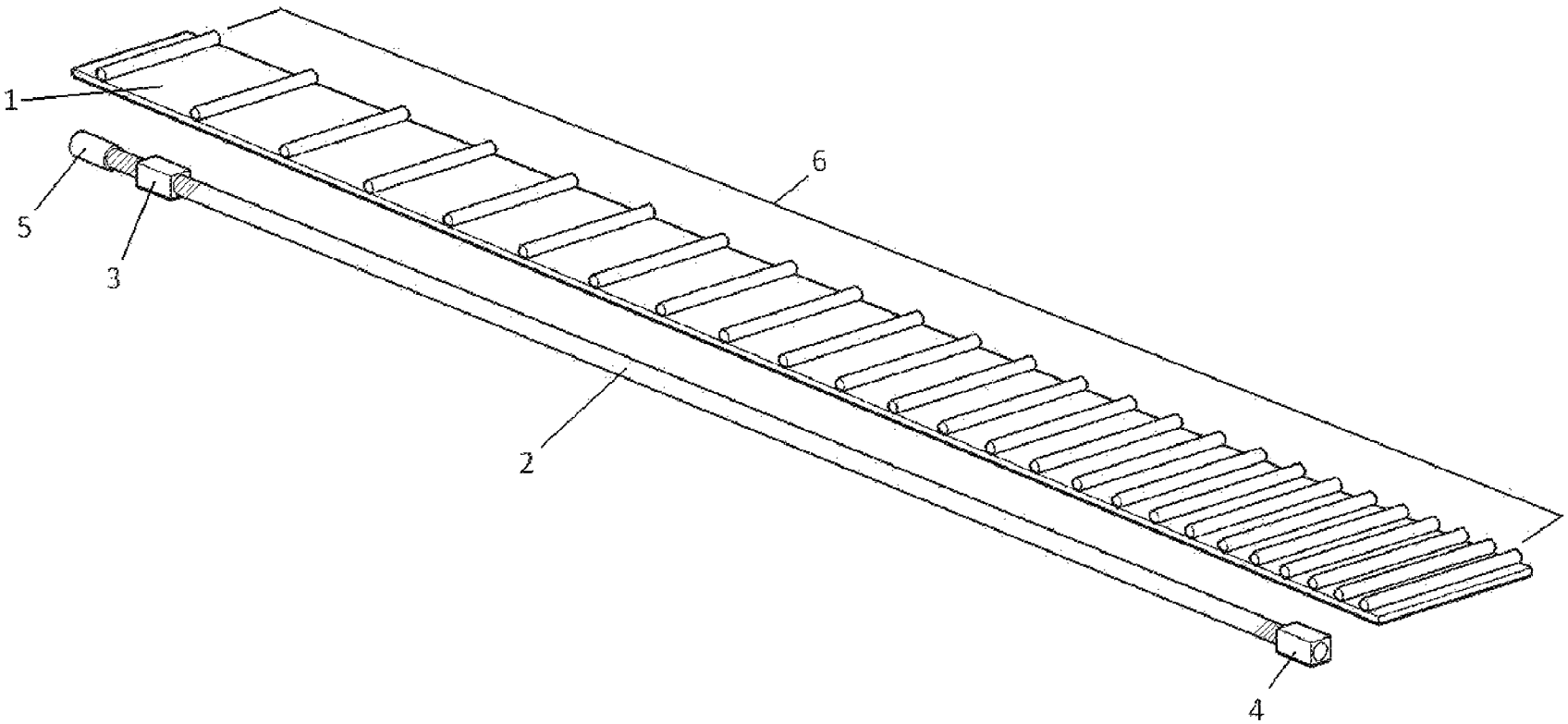
FIG. 3 is a top perspective of the separate fingerboard neck adjustment assembly.

FIG. 3 is a top perspective of the separate fingerboard neck adjustment assembly. Fingerboard plate 2 with attached frets 6 can function on its own as a fingerboard although frets 6 are optional. Adjustment mechanism which includes threaded rod 2, threaded blocks 3 and 4, and adjustment nut 6 must be assembled prior to attachment of threaded block 3 and 4 to plate 1.

Figure 4:
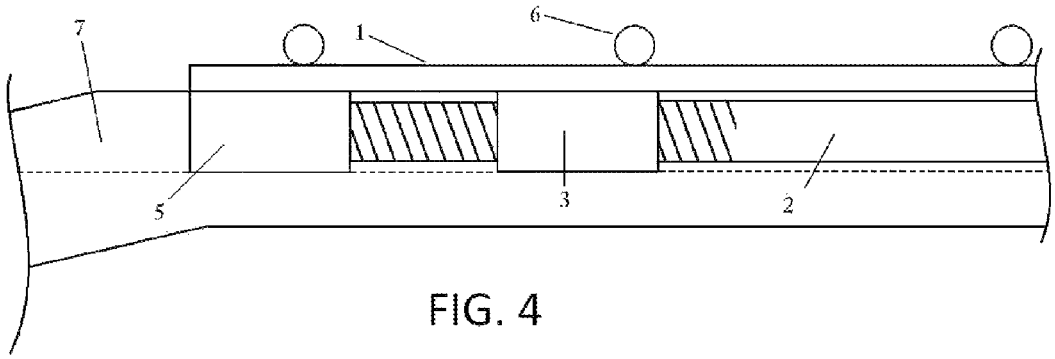
FIG. 4 is a section of a side view through all components of this invention assembled as a stringed instrument neck and fingerboard.

FIG. 4 is a section of a side view through all components of this invention assembled as a stringed instrument neck and fingerboard. Neck material 7 has a shallow slot cut down the middle of the longitudinal neck axis to accept neck adjustment assembly 2,3,4 (not shown), and 5. Fingerboard plate 1 is attached to top surface of neck material 7 and frets 6 are attached to top of plate 1.

Figure 5:
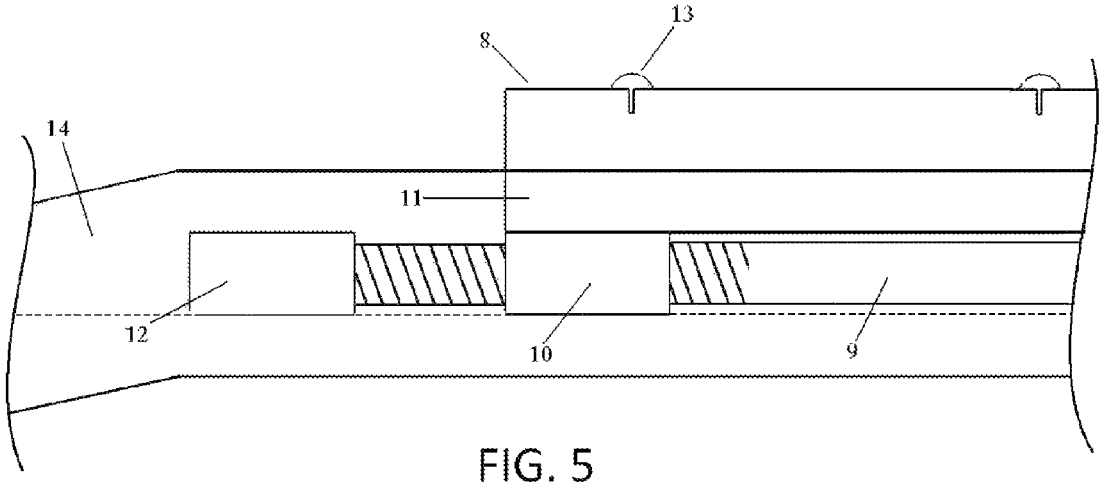
FIG. 5 is a section of a side view of traditional components of a neck, fingerboard and neck adjustment member which shows the additional bulk associated with prior art necks, fingerboards and truss rod assemblies.

FIG. 5 is a section of a side view of traditional components of a neck, fingerboard and neck adjustment member which shows the additional bulk associated with prior art necks, fingerboards and dual action truss rod assemblies. Traditional neck, fingerboard, and dual action truss rod assemblies have similar components of this invention yet lack the ability to reduce the bulkiness associated with traditional assembly methods and materials. Fingerboard 8 has fret slots cut into it to accept fret wire 13. Traditional dual action truss rod assembly 9, 10, 12, and additional component 11, also fits in a routed channel in the neck 14 but with the added bulkiness required to provide neck adjustability from truss rod component 9, 10, 11, and 12 and the resulting deeper channel that needs to be routed coupled with the bulkier fingerboards that are used, prior art neck assemblies lack the ability to provide necks which are less bulky, with dual action adjustability and a full scalloped fret board, or thin fingerboard on fretless models.

While this invention has been described in connection with preferred embodiments thereof, it is obvious that modifications and changes therein may be made by those skilled in the art to which it pertains without departing from the sprit and scope of the invention. Accordingly, the scope of this invention is to be limited only by the appended claims.

What is claimed is:

1. A fingerboard for a stringed musical instrument comprising:

a) A longitudinal plate having a first and a second end and a top and bottom surface;

b) A first threaded block attached to said bottom surface of said first end of said longitudinal plate;

c) A second threaded block attached to said bottom surface of said second end of said longitudinal plate;

d) A length of round stock having a first threaded end and a second threaded end, where said first threaded end is threaded into said first threaded block and said second threaded end is threaded into said second threaded block; and e) A means for rotating said round stock.

2. The fingerboard of claim 1 wherein said longitudinal plate is made of metal.

3. The fingerboard of claim 2 wherein said first and said second threaded block is made of metal.

4. The fingerboard of claim 3 wherein said threaded rod is made of metal.

5. The fingerboard of claim 4 wherein said longitudinal plate has a plurality of frets attached perpendicular to the longitudinal axis of said top surface of said longitudinal plate.

* * * * *